US007441526B1

(12) United States Patent
Minami

(10) Patent No.: US 7,441,526 B1
(45) Date of Patent: Oct. 28, 2008

(54) MULTIPOINT IGNITION DEVICE

(75) Inventor: Katsuaki Minami, Nagano (JP)

(73) Assignee: Miyama, Inc., Nagano (JP)

( * ) Notice: Subject to any disclaimer, the term of this patent is extended or adjusted under 35 U.S.C. 154(b) by 0 days.

(21) Appl. No.: 11/976,366

(22) Filed: Oct. 24, 2007

(51) Int. Cl.
*F02P 15/08* (2006.01)

(52) U.S. Cl. ..... 123/169 MG; 123/143 B; 123/310

(58) Field of Classification Search ..... 123/169 MG, 123/143 B, 310
See application file for complete search history.

(56) References Cited

U.S. PATENT DOCUMENTS 2,904,610 A * 9/1959 Morrison ..... 123/169 R
4,436,068 A * 3/1984 Nakamura et al. ..... 123/310
4,470,392 A * 9/1984 Yoshinaga et al. ..... 123/310
4,535,735 A * 8/1985 Yoshinaga et al. ..... 123/310
5,046,466 A * 9/1991 Lipski ..... 123/310
6,161,520 A * 12/2000 Clarke ..... 123/310
6,807,933 B2 * 10/2004 Lipski ..... 123/169 EL
7,299,785 B1 * 11/2007 Lee ..... 123/310

FOREIGN PATENT DOCUMENTS

JP 01-193080 8/1989
JP 02-123281 5/1990

* cited by examiner

*Primary Examiner*—Erick Solis
(74) *Attorney, Agent, or Firm*—Rabin & Berdo, PC

(57) ABSTRACT

A multipoint ignition device comprises: a head gasket (1) interposed between a cylinder head and a cylinder block of an engine, having an opening (3) in a position corresponding to a cylinder opening portion; and a plurality of intermediate members (6) connected respectively to a plurality of electrode pairs (2) and held in the head gasket (1). Respective heat values of the plurality of electrode pairs (2) are set individually by varying the contact area between the plurality of intermediate members (6) and the head gasket (1) according to the respective disposal positions of the plurality of intermediate members (6).

10 Claims, 4 Drawing Sheets

MULTIPOINT IGNITION DEVICE

TECHNICAL FIELD OF THE INVENTION

This invention relates to a multipoint ignition device used in a multipoint ignition engine having a plurality of ignition gaps in a single combustion chamber.

BACKGROUND OF THE INVENTION

JP2-123281A and JP1-193080A disclose a multipoint ignition engine in which a plurality of electrode pairs constituting ignition gaps are disposed around a cylinder opening portion of an engine such that an air-fuel mixture in a combustion chamber is ignited from the plurality of ignition gaps. According to this constitution, in comparison with a case in which ignition is performed using a conventional spark plug that performs ignition only from the center of the combustion chamber, combustion of the air-fuel mixture in a peripheral edge portion of the combustion chamber is promoted, enabling improvements in engine output and fuel economy.

SUMMARY OF THE INVENTION

When the temperature of the electrode pair is lower than a self-cleaning temperature (between 450° C. and 500° C.), carbon sticks to the electrode pair, and as a result, a secondary voltage leaks, causing pollution such that a spark from the electrode pair can no longer fly. Conversely, when the temperature of the electrode pair rises above 1000° C., the electrode pair itself becomes a heat source, and this leads to pre-ignition, whereby ignition occurs before the spark flies. Hence, the heat value (heat radiation property) of the electrode pair in this multipoint ignition device must be set at an appropriate value to ensure that the temperature of the electrode pair is held within an appropriate range of 450° C. to 1000° C., or more preferably 500° C. to 850° C. to leave a margin for error.

This invention has been designed in consideration of the problems in the prior art, and it is an object thereof to set the heat value of all electrode pairs in a multipoint ignition device appropriately to prevent pollution of the electrode pairs and the occurrence of pre-ignition.

A multipoint ignition device according to this invention comprises: an interposed member interposed between a cylinder head and a cylinder block of an engine, having an opening in a position corresponding to a cylinder opening portion; and a plurality of intermediate members connected respectively to a plurality of electrode pairs and held by the interposed member. Respective heat values of the plurality of electrode pairs are set individually by varying a contact area between the plurality of intermediate members and the interposed member according to the respective disposal positions of the plurality of intermediate members.

According to this invention, the heat values of all of the electrode pairs in a multipoint ignition device can be set appropriately, and as a result, pollution of the electrode pairs and the occurrence of pre-ignition can be prevented.

DESCRIPTION OF THE PREFERRED EMBODIMENT

An embodiment of this invention will be described below with reference to the attached drawings. In the following description, the heat radiation property of an electrode pair is expressed as a "heat value", similarly to a conventional spark plug. Accordingly, a good heat radiation property is referred to as a "high heat value", and a poor heat radiation property is referred to as a "low heat value".

Figure 1:
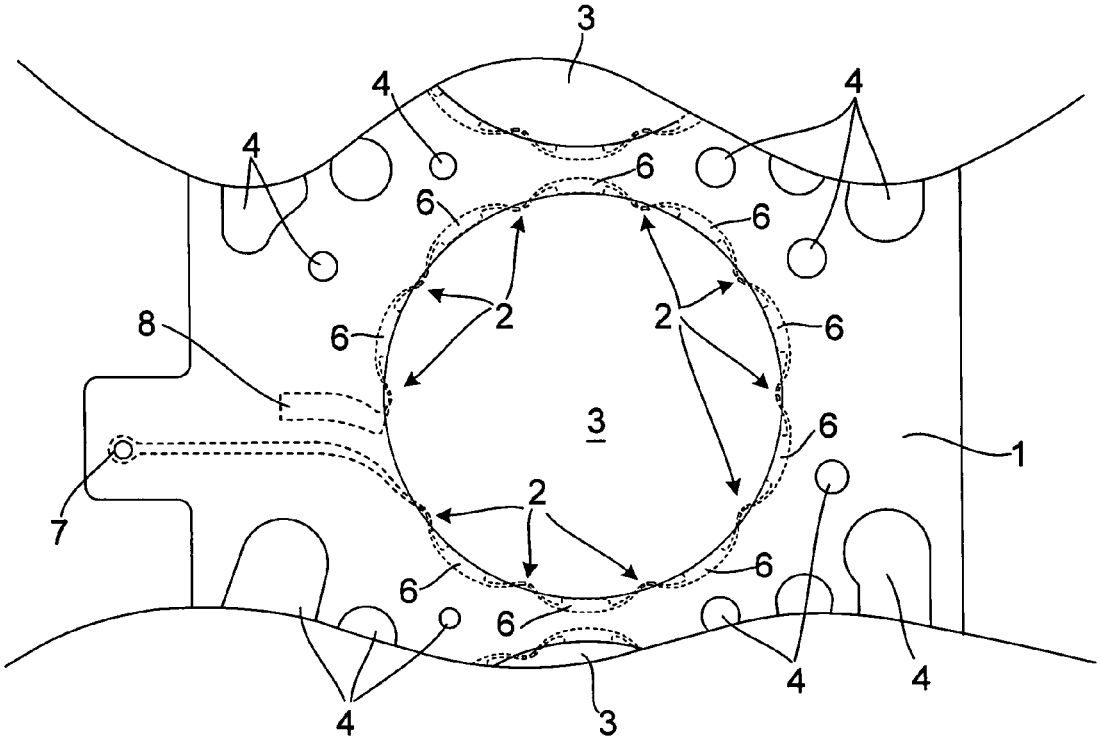
FIG. 1 is a constitutional diagram of a multipoint ignition device according to this invention.
Figure 2:
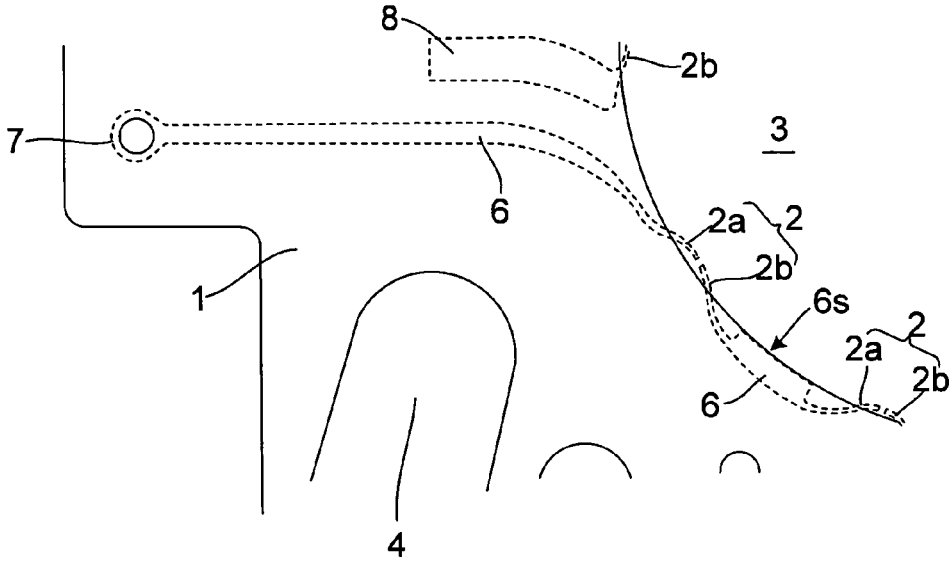
FIG. 2 is a partially enlarged view of the multipoint ignition device according to this invention.

FIG. 1 shows the constitution of a multipoint ignition device according to this invention, and FIG. 2 is a partially enlarged view thereof. In this embodiment, a multipoint ignition device is formed integrally with a head gasket 1 of an engine, and when the multipoint ignition device is sandwiched between a cylinder head and a cylinder block of the engine, a plurality of electrode pairs 2 are disposed around a cylinder opening portion. Each electrode pair 2 is constituted by a current-carrying electrode 2*a* and an earth electrode 2*b*, and an ignition gap is formed between the electrodes 2*a*, 2*b*.

The head gasket 1 is formed with a plurality of openings 3, 4. The largest, central opening 3 has a substantially identical diameter to the cylinder opening portion, and is formed in a position corresponding to the cylinder opening portion so as to form a part of a side wall of a combustion chamber when attached to the engine. The openings 4 disposed on the periphery of the opening 3 are water holes connected to cooling water passages formed in the cylinder head and cylinder block.

An intermediate member 6 is connected to each of the plurality of electrode pairs 2, and by holding the intermediate member 6 in the head gasket 1, the plurality of electrode pairs 2 are held on the head gasket 1. The electrode pairs 2 and intermediate members 6 are formed integrally from an identical material having a high heat resistance property, such as nickel, and although the boundary between the two members is not evident, for ease of description the thick part in the diametrical direction of the opening 3 will be referred to as the intermediate member 6, and the part that extends in a gently curving S shape from the intermediate member 6 to the two sides and projects partially into the opening 3 will be referred to as the electrode pair 2.

The plurality of electrode pairs 2 are electrically connected in series via the intermediate members 6. Hence, when a high secondary voltage is applied to a terminal 7, discharge occurs first in the ignition gap of the electrode pair 2 having the current-carrying electrode 2*a* that is connected to the terminal 7, after which discharge occurs in the adjacent electrode pair 2 thereto. Discharge then occurs around the opening 3 in sequence from the terminal 7 side until finally, discharge occurs in the ignition gap of the electrode pair 2 that is closest to an earth terminal 8.

Figure 3:
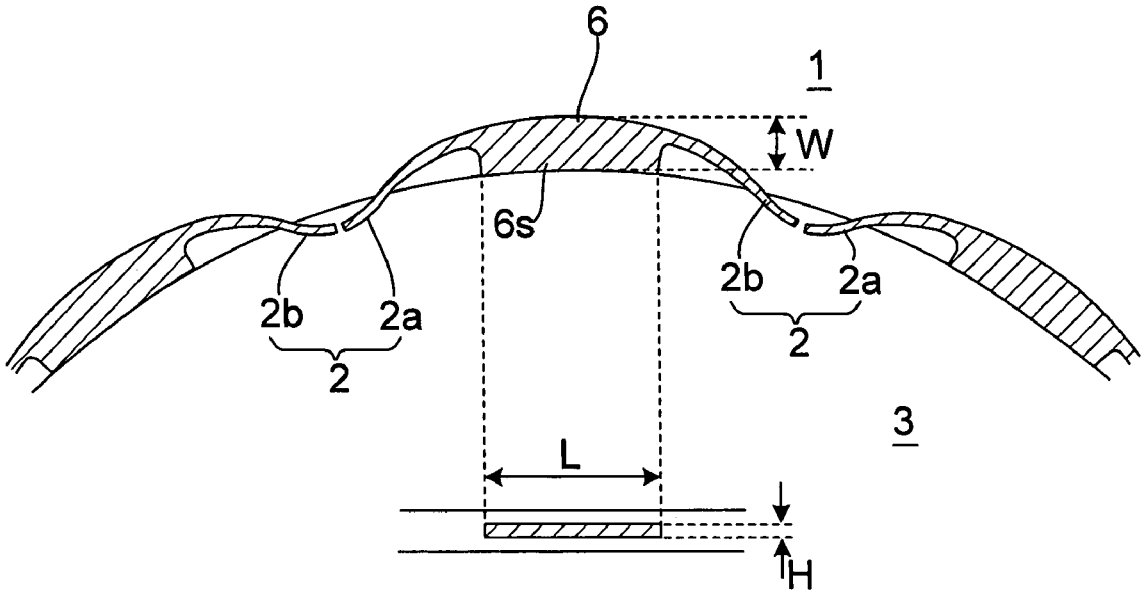
FIGS. 3 to 8 are views illustrating a heat value adjustment method.

Further, as shown in FIG. 3, each intermediate member 6 has an end portion 6*s* on the opening 3 side that extends to a peripheral edge of the opening 3 such that an end surface thereof is exposed to an inner peripheral surface of the opening 3. In this multipoint ignition device, the heat value of each electrode pair 2 is set individually by varying the contact area between the intermediate member 6 and the head gasket 1 and the surface area of the part of the intermediate member 6 that is exposed to the opening 3 (to be referred to hereafter as the "exposure area") according to the position in which the intermediate member 6 is disposed. For example, setting is performed such that the electrode pair 2 disposed in a position of the combustion chamber having a high wall surface temperature has a high heat value, whereas the electrode pair 2 disposed in a position having a low wall surface temperature has a low heat value.

Next, a specific method of adjusting the heat value of the electrode pairs 2 will be described. To modify the heat value of a certain electrode pair 2, the contact area between the intermediate member 6 that is connected to the electrode pair 2 and the head gasket 1 is modified by modifying at least one of a length L of the intermediate member 6, a width W of the intermediate member 6, and a height H (see FIG. 3) of the part that is not exposed to the opening 3.

For example, to raise (increase) the heat value of a certain electrode pair 2 above the other electrode pairs 2 so that the electrode pair 2 becomes a cold type, at least one of the length L, width W and height H of the part of the intermediate member 6 connected to the electrode pair 2 that is buried in the head gasket 1 should be increased above that of the other electrode pairs 2, thereby increasing the contact area between the intermediate member 6 and the head gasket 1. By increasing the contact area between the intermediate member 6 and the head gasket 1, the heat of the electrode pair 2 escapes to the cylinder head and cylinder block of the engine through the intermediate member 6 and the head gasket 1 more easily, and thus the heat value of the electrode pair 2 can be raised.

Figure 4:
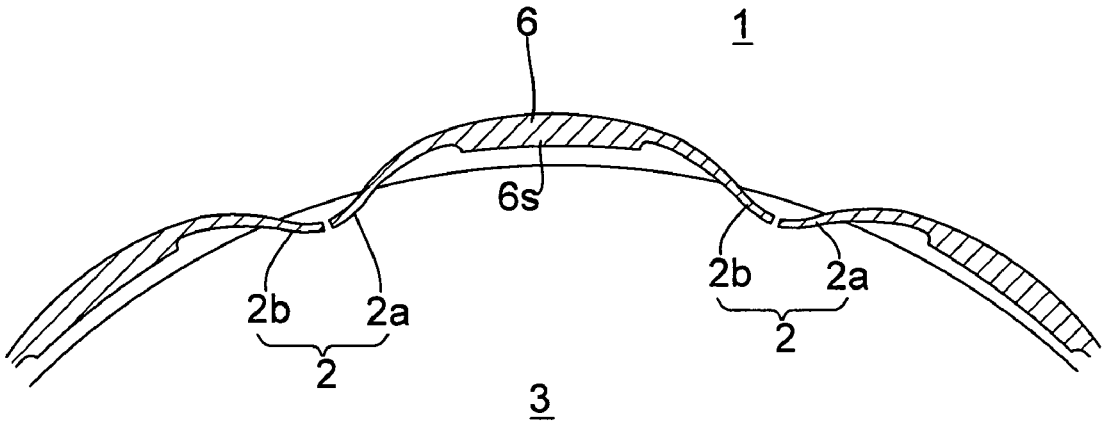

As shown in FIG. 4, to increase the heat value of the electrode pair 2 further, the end portion 6*s* of the intermediate member 6 connected to the electrode pair 2 may be buried in the head gasket 1 completely. With this constitution, the amount of heat received by the intermediate member 6 from combustion gas decreases, leading to a decrease in the temperature of the intermediate member 6 and an increase in the ease with which the heat of the electrode pair 2 escapes through the intermediate member 6. Thus, the heat value of the electrode pair 2 can be raised further.

Figure 5:
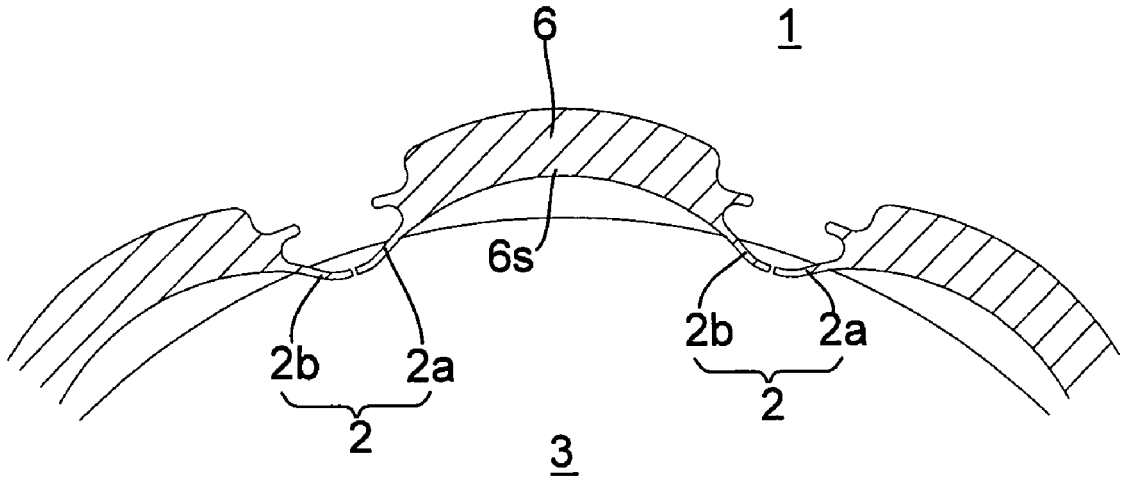

Then, by increasing at least one of the length L, width W and height H of the intermediate member 6 connected to the electrode pair 2 even further above the other electrode pairs 2 from this state such that the contact area with the head gasket 1 increases, the heat value of the electrode pair 2 can be raised even further. FIG. 5 shows an example in which the intermediate member 6 has been completely buried in the head gasket 1 and the width W of the intermediate member 6 has been increased to raise the heat value of the electrode pair 2 connected to the intermediate member 6.

Further, although not shown in the figures, the heat value of the electrode pair 2 may be raised even higher by implementing surface processing on the surface of the intermediate member 6 connected to the electrode pair 2 to improve the heat radiation property of the intermediate member 6 and thereby improve thermal conductivity from the intermediate member 6 to the head gasket 1. As the surface processing implemented on the surface of the intermediate member 6, processing to plate the intermediate member 6 with a material (copper or platinum, for example) exhibiting higher thermal conductivity than the material of the intermediate member 6, processing to increase the contact area between the intermediate member 6 and the head gasket 1 by forming minute irregularities on the surface of the intermediate member 6, and so on may be employed.

On the other hand, to lower (reduce) the heat value of the electrode pair 2 below the other electrode pairs 2 so that the electrode pair 2 becomes a hot type, at least one of the length L, width W and height H of the part of the intermediate member 6 connected to the electrode pair 2 that is buried in the head gasket 1 should be reduced below that of the other electrode pairs 2, thereby reducing the contact area between the intermediate member 6 and the head gasket 1. By reducing the contact area between the intermediate member 6 and the head gasket 1, the heat of the electrode pair 2 is less likely to escape to the cylinder head and cylinder block of the engine through the intermediate member 6 and the head gasket 1, and thus the heat value of the electrode pair 2 can be lowered.

Figure 6:
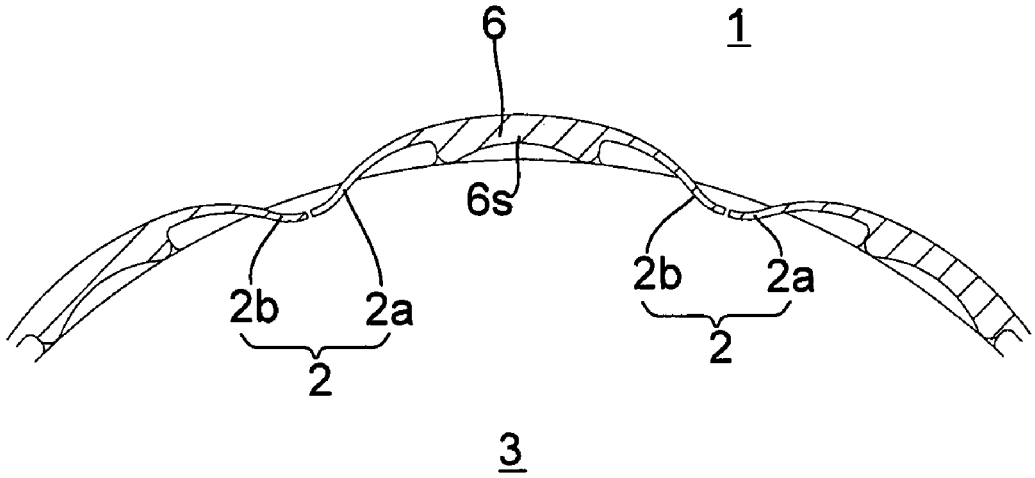

To lower the heat value of the electrode pair 2 further, the length L and height H of the end surface of the end portion 6*s* of the intermediate member 6 connected to the electrode pair 2, which is exposed to the opening 3, may be increased. Alternatively, as shown in FIG. 6, the end surface of the end portion 6*s* may be bent toward the inside of the head gasket 1 from the state shown in FIG. 3, thereby increasing the exposure area of the intermediate member 6 to the opening 3. When the exposure area of the intermediate member 6 to the opening 3 is increased, the amount of heat transferred from the combustion gas to the electrode pair 2 via the intermediate member 6 increases, and thus the heat value of the electrode pair 2 can be lowered further.

Figure 7:
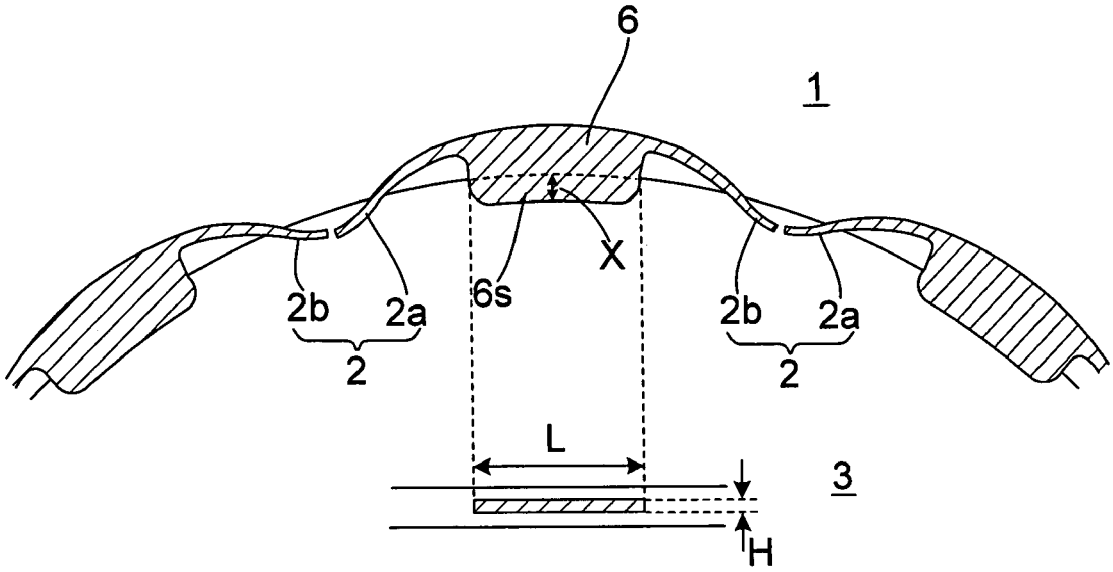

Further, as shown in FIG. 7, when the end portion 6*s* projects into the opening 3, the exposure area of the intermediate member 6 to the opening 3 increases further, enabling a further reduction in the heat value of the electrode pair 2 connected thereto. Moreover, by bending the end surface of the end portion 6*s* projecting into the opening 3 as shown in FIG. 8 such that the exposure area of the intermediate member 6 to the opening 3 increases even further, the heat value of the electrode pair 2 connected thereto can be reduced even further.

Figure 8:
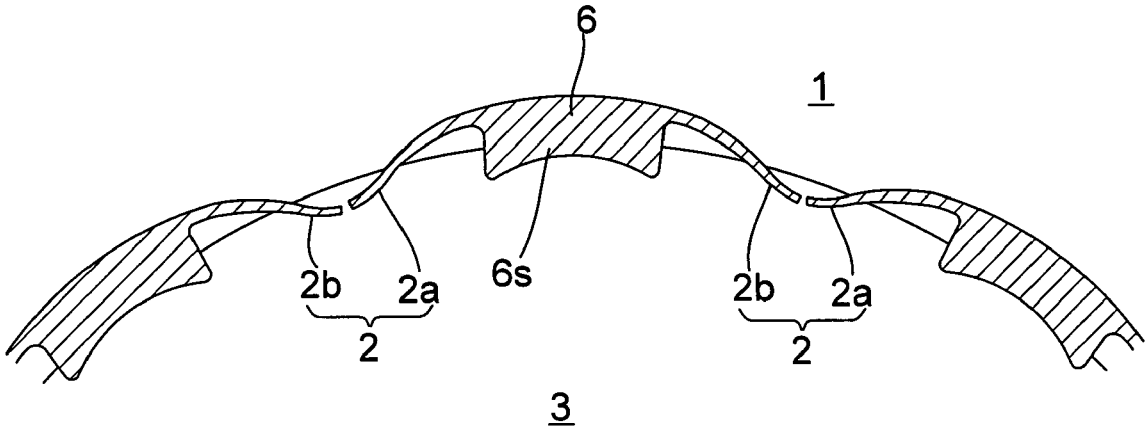

In the examples shown in FIGS. 6 and 8, the exposure area of the intermediate member 6 to the opening 3 is increased by bending the end surface of the end portion 6*s*. However, the exposure area may also be increased by forming irregularities on the end surface, and therefore grooves, indentations, projections, and so on may be formed on the end surface of the end portion 6*s* instead of bending the end surface of the end portion 6*s*. Further, in the constitution shown in FIG. 8, the upper surface or lower surface of the exposed end portion 6*s* may be bent instead of the end surface of the end portion 6*s*. Furthermore, in the constitutions shown in FIGS. 7 and 8, the exposure area of the intermediate member 6 to the opening 3 may be modified by modifying the length L or height H of the end portion 6*s* projecting into the opening 3, or by modifying a projection amount X into the opening 3.

Here, the contact area between the intermediate member 6 and head gasket 1 is modified principally by modifying the dimensions of the intermediate member 6, but the method of modifying the contact area is not limited thereto. As an example of another method of modifying the contact area, the contact area between the intermediate member 6 and the head gasket 1 may be increased by forming irregularities on the surface of the intermediate member 6 or the inner surface of the head gasket 1 which contacts the intermediate member 6. Conversely, the contact area may be reduced by using these irregularities to form voids between the intermediate member 6 and head gasket 1 or dispose a thermal insulation material in the gaps.

Hence, according to this invention, the heat values of the electrode pairs 2 can be set individually, and by setting the heat values of all of the electrode pairs 2 appropriately, pollution of the electrode pairs 2 and the occurrence of pre-ignition can be prevented.

It should be noted that the specific heat value adjustment methods described above may be executed in appropriate combinations, and in so doing, wider-range heat value adjustment can be realized.

What is claimed is:

1. A multipoint ignition device in which a plurality of electrode pairs, each constituting an ignition gap, are disposed around a cylinder opening portion of an engine, comprising:

an interposed member interposed between a cylinder head and a cylinder block of the engine, having an opening in a position corresponding to the cylinder opening portion; and a plurality of intermediate members connected respectively to the plurality of electrode pairs and held by the interposed member, wherein respective heat values of the plurality of electrode pairs are set individually by varying a contact area between the plurality of intermediate members and the interposed member according to respective disposal positions of the plurality of intermediate members.

2. The multipoint ignition device as defined in claim 1, wherein the contact area between the plurality of intermediate members and the interposed member is varied according to the respective disposal positions of the plurality of intermediate members by varying at least one of a length, a width, and a height of the plurality of intermediate members.

3. The multipoint ignition device as defined in claim 1, wherein, by exposing at least one of the plurality of intermediate members to the opening, the heat value of an electrode pair that is connected to the at least one intermediate member is reduced.

4. The multipoint ignition device as defined in claim 3, wherein, by increasing a surface area of a part of the at least one intermediate member that is exposed to the opening, the heat value of the electrode pair connected to the at least one intermediate member is reduced further.

5. The multipoint ignition device as defined in claim 4, wherein, by providing an irregularity on a surface of the part of the at least one intermediate member that is exposed to the opening, the surface area of the part of the at least one intermediate member that is exposed to the opening is increased.

6. The multipoint ignition device as defined in claim 4, wherein the surface area of the part of the at least one intermediate member that is exposed to the opening is increased by causing the part of the at least one intermediate member that is exposed to the opening to project into the opening.

7. The multipoint ignition device as defined in claim 1, wherein, by implementing surface processing to increase a heat radiation property of at least one of the plurality of intermediate members, the heat value of an electrode pair that is connected to the intermediate member subjected to the surface processing is increased.

8. The multipoint ignition device as defined in claim 7, wherein the surface processing is plating implemented on the surface of the at least one intermediate member using a material exhibiting higher thermal conductivity than the intermediate member.

9. The multipoint ignition device as defined in claim 7, wherein the surface processing is processing to form an irregularity on the surface of the at least one intermediate member.

10. The multipoint ignition device as defined in claim 1, wherein the plurality of electrode pairs and the plurality of intermediate members are formed integrally from an identical material.

* * * * *